US008167254B2

(12) United States Patent
Hopkins

(10) Patent No.: US 8,167,254 B2
(45) Date of Patent: May 1, 2012

(54) TRASH CONTAINER EMPTYING MECHANISM

(76) Inventor: Dale Hopkins, Old Town, ID (US)

( * ) Notice: Subject to any disclaimer, the term of this patent is extended or adjusted under 35 U.S.C. 154(b) by 762 days.

(21) Appl. No.: 12/154,236

(22) Filed: May 22, 2008

(65) Prior Publication Data

US 2009/0290963 A1 Nov. 26, 2009

(51) Int. Cl.
*A47F 5/12* (2006.01)

(52) U.S. Cl. ..... 248/137; 280/47.17

(58) Field of Classification Search ..... 248/137; 280/47.17; 414/444
See application file for complete search history.

(56) References Cited

U.S. PATENT DOCUMENTS

| | | | | | |
|---|---|---|---|---|---|
| 536,629 | A | | 4/1895 | Hvass | |
| 1,220,640 | A | | 3/1917 | Kelly | |
| 1,444,245 | A | | 2/1923 | Hall | |
| 1,798,565 | A | * | 3/1931 | Trullinger | 248/129 |
| 1,816,411 | A | | 7/1931 | Tillinger | |
| 2,634,933 | A | | 4/1953 | Grimsley | |
| 2,665,098 | A | | 1/1954 | Oden | |
| 2,903,219 | A | | 9/1959 | Ingham, Jr. | |
| 2,952,434 | A | | 9/1960 | Blanchard | |
| 3,658,383 | A | | 4/1972 | Sisson | |
| 3,930,630 | A | * | 1/1976 | Wulff | 248/129 |
| 4,187,950 | A | * | 2/1980 | Peet | 414/421 |
| 4,192,491 | A | * | 3/1980 | Riegler et al. | 266/245 |
| 4,193,161 | A | | 3/1980 | Scott | |
| 4,278,386 | A | * | 7/1981 | Eranosian | 414/421 |
| 4,313,701 | A | | 2/1982 | Brust | |
| 4,536,033 | A | | 8/1985 | Allen | |
| 5,316,248 | A | * | 5/1994 | Allen | 248/129 |
| 5,361,978 | A | | 11/1994 | Monroe | |
| 5,454,625 | A | * | 10/1995 | Christensen et al. | 298/18 |
| 6,820,940 | B2 | | 11/2004 | Gonzalez | |
| 7,677,581 | B2 | * | 3/2010 | Vanderberg et al. | 280/47.26 |

* cited by examiner

*Primary Examiner* — Joshua Rudawitz
(74) *Attorney, Agent, or Firm* — William A. Jeckle

(57) ABSTRACT

A trash container emptying mechanism provides an upstanding "U" shaped yoke with two horizontally spaced apart vertically extending arms each having a perpendicular base portion mounted to wheeled cart. A trash container carrier having a partially circumferentially extending rigid upper support, a vertically spaced apart bottom support and at least one vertical leg communicating between the rigid upper support and the bottom support is pivotally carried within the yoke on two offset pivot spacers and two horizontal axles extending therethrough and therebetween. A flexible length adjustable strap releasably secures the trash container to the carrier and a removable position locking pin extends through aligned axle holes defined in yoke vertical arm and carrier to positionally secure the carrier and trash container in a vertical orientation within the yoke.

2 Claims, 4 Drawing Sheets

TRASH CONTAINER EMPTYING MECHANISM

RELATED APPLICATIONS

There are no applications related hereto heretofore filed in this or in any foreign country.

BACKGROUND OF INVENTION

1. Field of Invention

This invention relates to containers, and more particularly to a trash container carrying mechanism that can be optionally pivoted about a horizontal axis to ease emptying the trash container.

2. Background and Description of Prior Art

Emptying trash containers is a daily task for many persons especially those involved in the janitorial trade who clean offices, schools, cafeterias and other places where people work and congregate. In the course of such work, persons frequently move a wheeled cart from office to office or location to location. The wheeled cart commonly carries various cleaning tools and supplies and also carries a large trash container into which the contents of smaller trash containers are emptied. Typically the cart is supported on plural spacedly arrayed caster-type wheels which raise the cart spacedly above the supporting ground surface and make the cart maneuverable.

The trash container typically has a plastic bag liner into which the trash is deposited. When the trash container is full of waste material the user must lift the trash container liner (and the collected waste therein) out of the trash container for disposal in a dumpster or the like. Because the trash containers are commonly industrial size "Rubber Maid®" type trash containers, and because the trash container is raised an additional distance above the supporting ground surface by the cart wheels, removing the trash container liner can be difficult and is a frequent cause of industrial injuries such as back strains, pulled muscles and sprained shoulders leading to health problems and industrial insurance costs.

There are known devices that assist in the removal of trash container liners from trash containers, but such devices have various drawbacks including they are not mountable to existing janitorial carts, they are not adaptable to standard trash containers, the trash container is integrally built into the device, they are not readily mobile and they require a user to lift the entire weight of the trash container and material contained therein to empty the container among other drawbacks.

What is needed is an apparatus that assists a person in removing a loaded and heavy trash container liner from a trash container without subjecting the person to possible injury. The apparatus must be easy to use, stable, durable and safe.

My invention overcomes various of the aforementioned drawbacks by providing an improved trash container emptying mechanism that is mountable to a wheeled platform and known janitorial carts. My invention positionally maintains a trash container in an upright orientation and also enables the trash container to be pivoted for emptying when desired. My invention accommodates use of standard trash container and trash container liners, and allows the liner and trash contained therein to be easily removed from the trash container without having to lift the filled liner upwardly and over the circumferential edge of the trash container.

My trash container emptying mechanism provides an upstanding "U" shaped yoke having two spaced apart vertical arms affixed to a wheeled base. A carrier is pivotally supported by the yoke and has a partially circumferentially extending upper support, with two offset pivot spacers at diametrically opposite positions, and a vertically spaced apart bottom support with at least one vertical support leg communicating therebetween.

An adjustable strap secures the trash container within the carrier by "squeezing" the trash container into direct physical contact with the upper support, the vertical leg and the bottom support.

Pivot axles communicate between each vertical arm of the yoke and the carrier. The position of the pivot axles, relative to the carrier and trash container allows the carrier and trash container to swing as a pendulum. Gravity biases the trash container bottom support and bottom of the trash container to a position between the yoke vertical arms and when the carrier is pivoted to an emptying position also biases the filled liner toward removal from the trash container.

A locking mechanism is carried on at least one yoke vertical arm and on the adjacent portion of the carrier to prevent the carrier (and trash container carried therein) from pivoting on the pivot axles unexpectedly. The locking mechanism is preferably a removable elongate locking pin with a spring biased radially protruding ball bearing proximate one end that extends through aligned orifices defined in the yoke vertical arm and the carrier.

In use, a trash container having a trash container liner therein is secured in the carrier with the adjustable strap. The user performs his duties adding waste to the trash container. When the user is ready to empty the trash container, the user disconnects the locking mechanism and pivots the trash container and carrier about the pivot axles. As the trash container and carrier pivot, the upper orifice of the trash container moves downwardly along an arc allowing the user to pull the "filled" liner and material contained therein, out of the trash container without having to lift the filled liner to a height sufficient to "clear" the top edge of the trash container. Gravity assists in removal of the filled liner from the trash container as the trash container and carrier are pivoted.

My invention does not reside in any single one of the identified features individually but rather in the synergistic combination of all of its structures, which give rise to the functions necessarily flowing therefrom as hereinafter claimed.

SUMMARY

A trash container emptying mechanism provides an upstanding "U" shaped yoke with two horizontally spaced apart vertical arms each having a perpendicular base portion mounted to wheeled cart. A trash container carrier having a partially circumferentially extending rigid upper support, a vertically spaced apart bottom support and at least one vertical leg communicating between the rigid upper support and the bottom support is pivotally carried within the yoke on two offset pivot spacers and two horizontal axles extending therethrough and therebetween. A flexible strap secures the trash container to the carrier and a removable position locking pin extends through aligned holes defined in yoke vertical arm and carrier to positionally secure the carrier and trash container in a vertical orientation within the yoke.

In providing such an system it is:

a principal object to provide a trash container emptying apparatus that eliminates the need to lift a trash container liner vertically out of the trash container.

a further object to provide such an apparatus that pivots on two spaced apart horizontally aligned axes.

a further object to provide such an apparatus that is usable with a standard commercial trash container.

a further object to provide such an apparatus that is positionally securable in an upright orientation to facilitate filling of the trash container.

a further object to provide such an apparatus that may be pivoted to ease removal of a filled trash container liner from the trash container a further object to provide such an apparatus that uses mechanical advantage and gravity to remove a filled trash container liner from a trash container.

a further object to provide such an apparatus that is mountable to a wheeled janitorial cart.

a further object to provide such apparatus that is adjustable in circumferential size to accommodate various sizes trash containers.

a further object to provide such an apparatus that is stable on a wheeled cart.

a still further object to provide such an apparatus that reduces the risk of worksite and industrial injuries.

Other and further objects of my invention will appear from the following specification and accompanying drawings which form a part hereof. In carrying out the objects of my invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 1:
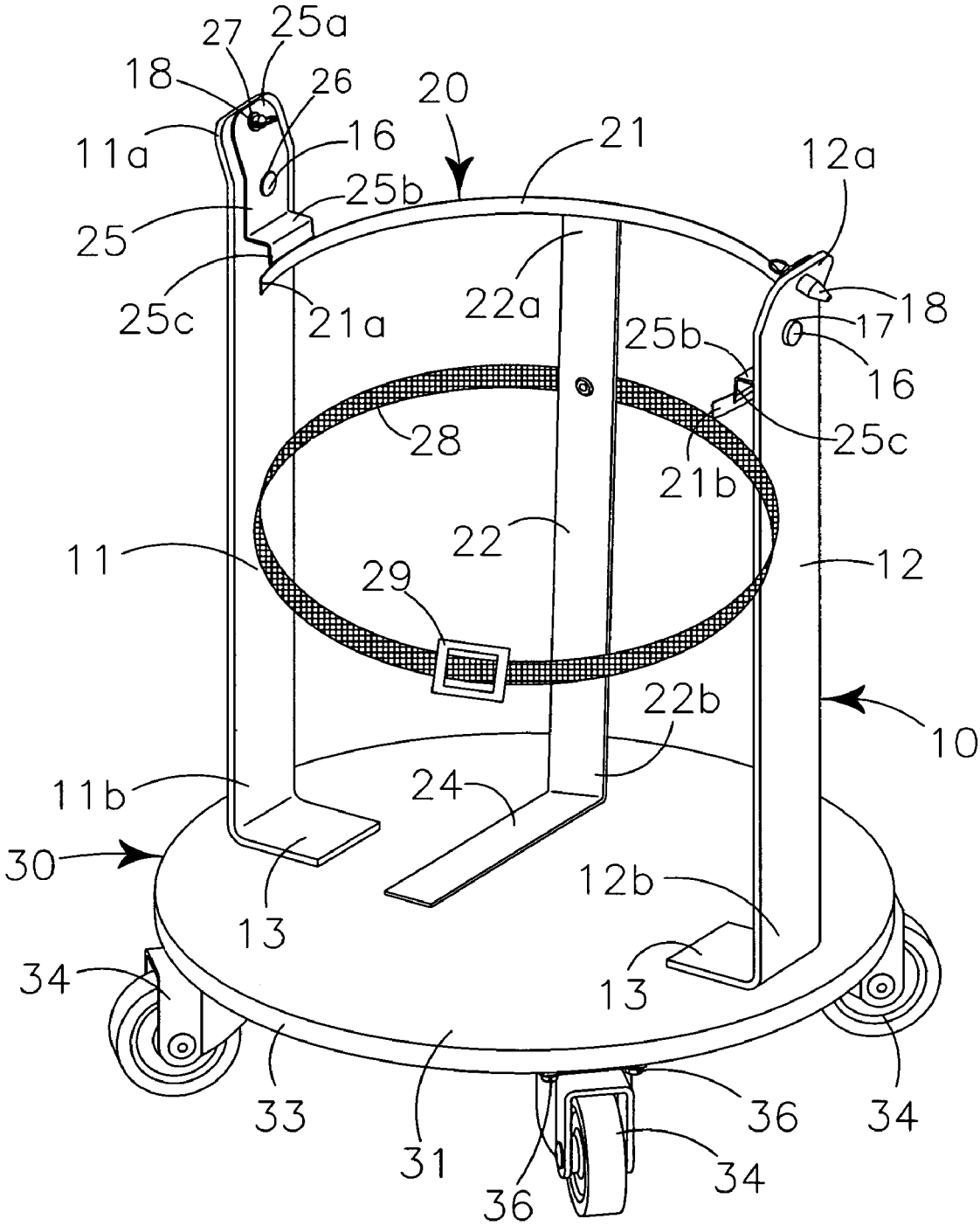
FIG. 1 is an isometric top and side view of the trash container emptying mechanism.

My trash container emptying mechanism provides an upstanding "U" shaped yoke 10 supporting a pivotal trash container carrier 20 and mounted to a wheeled cart 30.

The upstanding "U" shaped yoke 10 is formed of a strong, rigid and durable material such as galvanized steel or high density polyethylene plastic and has two horizontally spaced apart vertically extending arms 11, 12 each arm having an upper end portion 11*a*, 12*a* and an opposing lower end portion 11*b*, 12*b*.

The upper end portion 11*a*, 12*a* of each vertical arm 11, 12 defines an axle hole 17 and a locking pin hole 19.

A perpendicular base portion 13 at the lower end portion 11*b*, 12*b* of each arm 11, 12 defines plural spacedly arrayed fastener holes (not shown) for fasteners (not shown) extending therethrough to secure the vertical arm 11, 12 to the wheeled cart 30.

Figure 7:
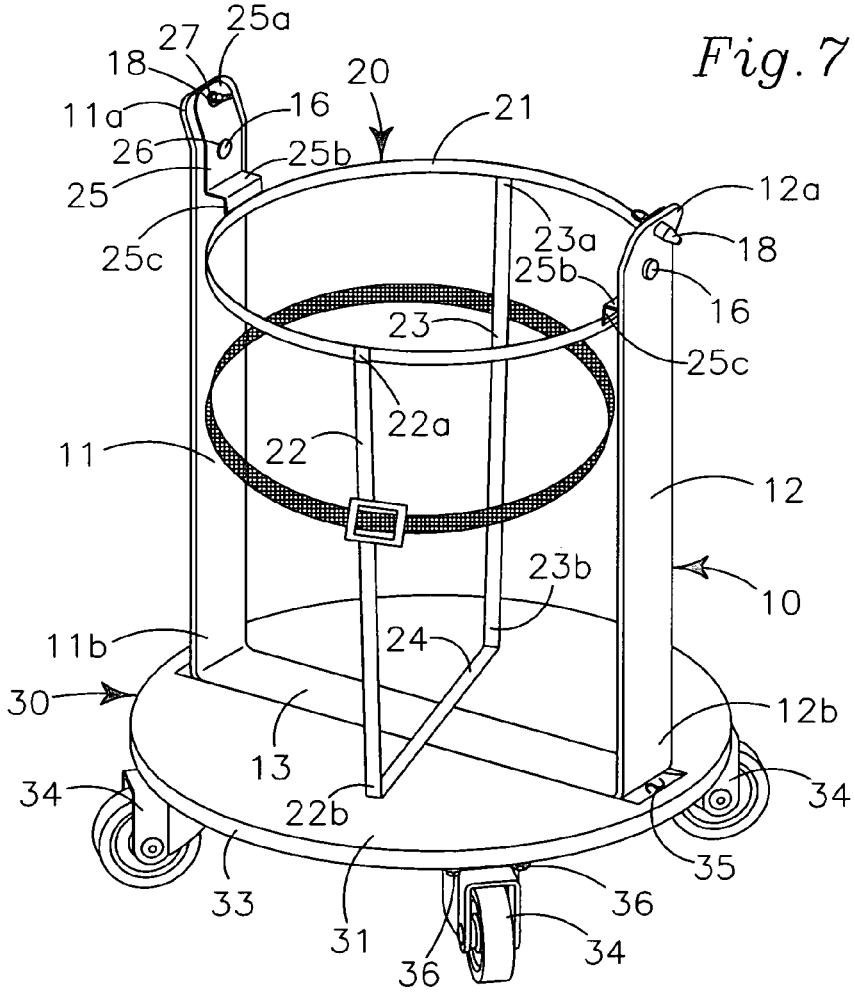
FIG. 7 is an isometric top, front and side view of a second embodiment of my trash container emptying mechanism showing the carrier upper support formed of an annulus and having two diametrically opposed vertical legs communicating between the upper support and the bottom support.
Figure 5:
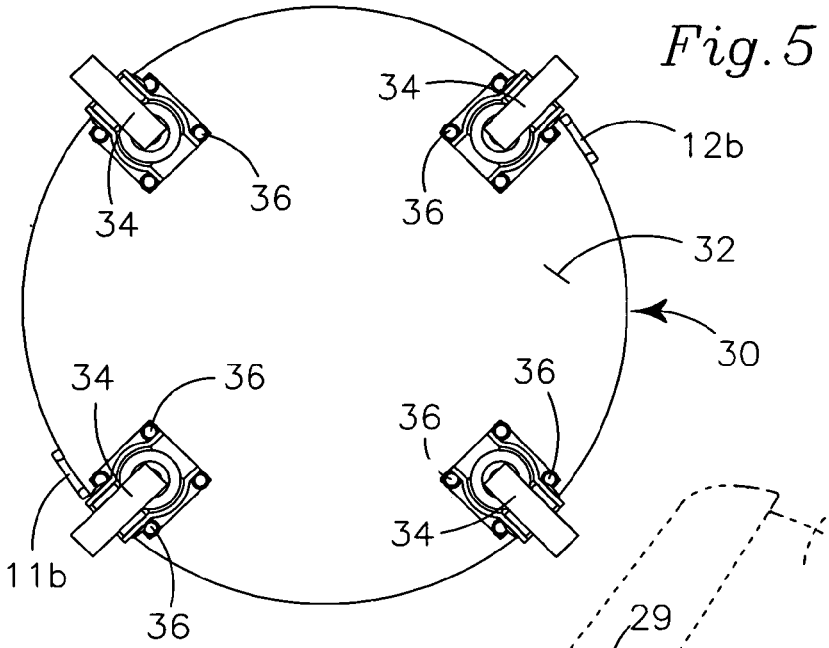
FIG. 5 is an orthographic bottom view thereof.
Figure 6:
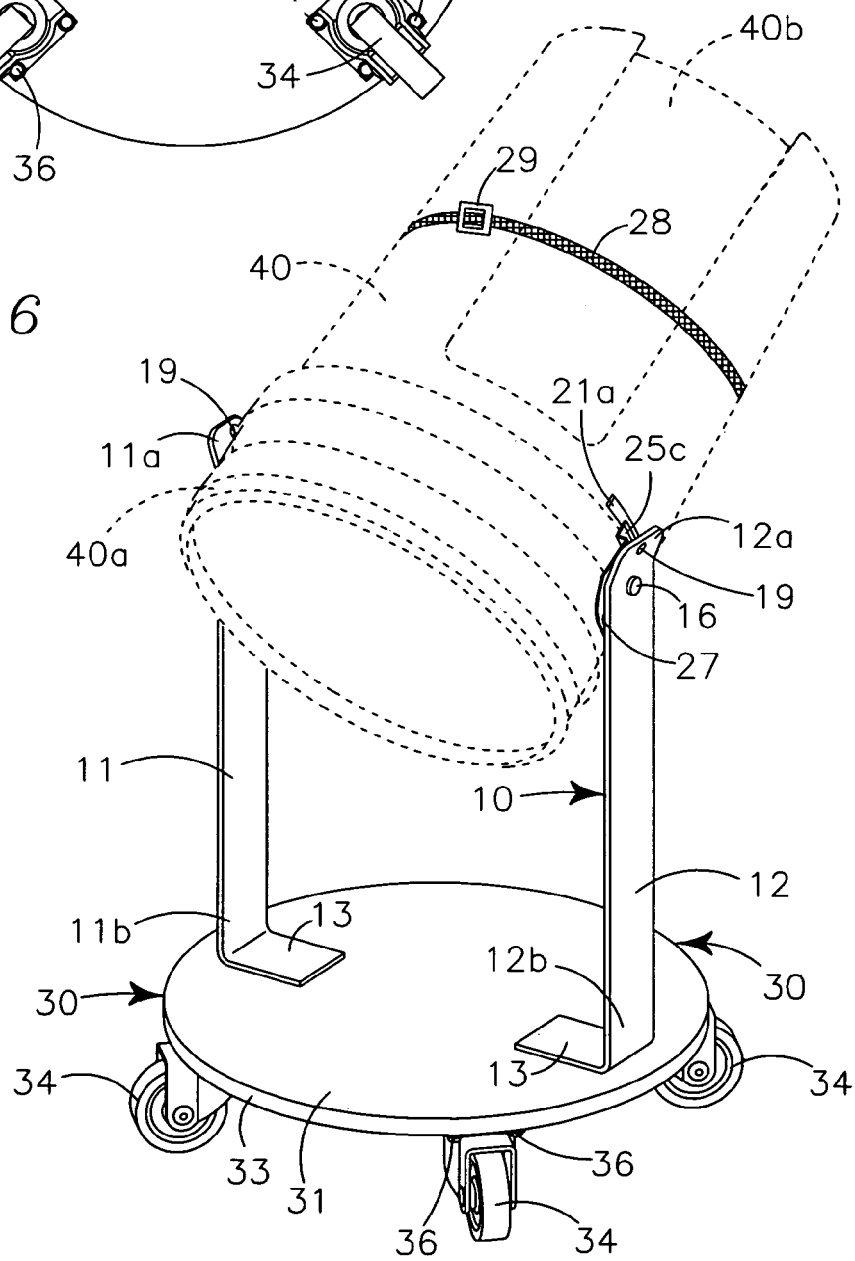
FIG. 6 is an isometric top, front and side view of the trash container emptying mechanism showing the carrier and a trash container, in dashed outline, pivoted to an emptying orientation.

As shown in FIG. 1, each vertically extending yoke arm 11, 12 may have a perpendicular base portion 13 that is mounted to the wheeled cart 30. In a second embodiment, as shown in FIG. 7, the perpendicular base portion 13 may structurally communicate with and extend between the lower end portions 11*b*, 12*b* of the vertical arms 11, 12 and may be flush mounted on the wheeled cart 30 such as in a groove 35 defined in top 31 of the wheeled cart 30, or may be surface mounted on the top 31 of the wheeled cart 30.

The trash container carrier 20 is pivotally carried between the yoke vertical arms 11, 12 and has a rigid partially circumferentially extending upper support 21 forming a segment of a circle having an arc greater than 180 degrees. A horizontal bottom support 24 for supporting a bottom portion of a trash container 40 is spaced vertically below the rigid upper support 21 and a vertical leg 22 structurally communicates between the rigid upper support 21 and the horizontal bottom support 24.

Offset pivot spacers 25 are carried by the rigid upper support 21 at diametrically opposite positions thereon. Each offset pivot spacer 25 has an upper end portion 25*a* that has the same configuration as the upper end portions 11*a*, 12*a* of the yoke vertical arms 11, 12, and a lower end portion 25*c* that is displaced laterally inwardly by medial offset bend 25*b*. The lower end portion 25*c* of each offset pivot spacer 25 is structurally interconnected with the rigid upper support 21 at diametrically opposed positions thereon and generally at a position spaced 90 degrees from upper end portion 22*a*, of the vertical leg 22. The offset bends 25*b* provide horizontal spacing between the rigid upper support 21 and the yoke vertical arms 11, 12 to accommodate the taper of the trash container and also to accommodate upper circumferential edge portions 40*a* of the trash container 40 that commonly extend radially outwardly from circumferential side portions of the trash container 40 to add strength and rigidity to the trash container 40. The offset bends 25*b* also increase the stability of the mechanism by further spacing apart the yoke vertical arms 11, 12 providing a wider stance for the yoke 10.

An axle hole 26 is defined in each offset pivot spacer 25 spacedly adjacent the offset bend 25*b* opposite the bottom end portion 25*c* for a pivot axle 16 that communicates between each offset pivot spacer 25 and the adjacent yoke vertical arm 11, 12. The upper end portion 25*a* of each offset pivot spacer 25 defines locking pin hole 27 for a locking pin 18 that removably extends therethrough and also through the locking pinhole 19 defined in the upper end portion 11*a*, 12*a* of the proximate yoke vertical arm 11, 12.

A flexible strap 28, formed of material such as nylon, and having a releasable adjustable fastener 29 such as a buckle, communicates with the carrier 20 and extends at least partially about the circumference of the trash container 40. The flexible strap 28 secures the trash container 40 within the carrier 20 providing frictional engagement therebetween and preventing the trash container 40 from separating from the carrier 20 when the carrier 20 is pivoted relative to the yoke 10 and wheeled platform 30 for emptying.

In another possible embodiment, end portions of the flexible strap 28 opposite the adjustable fastener 29 are secured to and extend from end portions 21*a*, 21*b* of the rigid upper support 21 so that the flexible strap 28, in conjunction with the rigid partially circumferentially extending upper support 21 encircle the circumference of the trash container 40 and secure the trash container 40 to the carrier 20.

The locking pin 18 has one end portion that permanently carries a flexible fastening means (not shown), such as a link chain or cable, to prevent loss. The opposing end portion of the locking pin 18 is tapered to ease insertion through the aligned locking pin holes 27, 19 defined in the offset spacers 25 and the yoke vertical arms 11, 12 respectively. A known type of position maintaining means (not shown), such as a radially protruding spring biased ball bearing (not shown) may be incorporated in the locking pin 18 to prevent inadvertent and unintentional withdrawal of the locking pin 18 from the aligned adjacent locking pin holes 27, 19.

Figure 3:
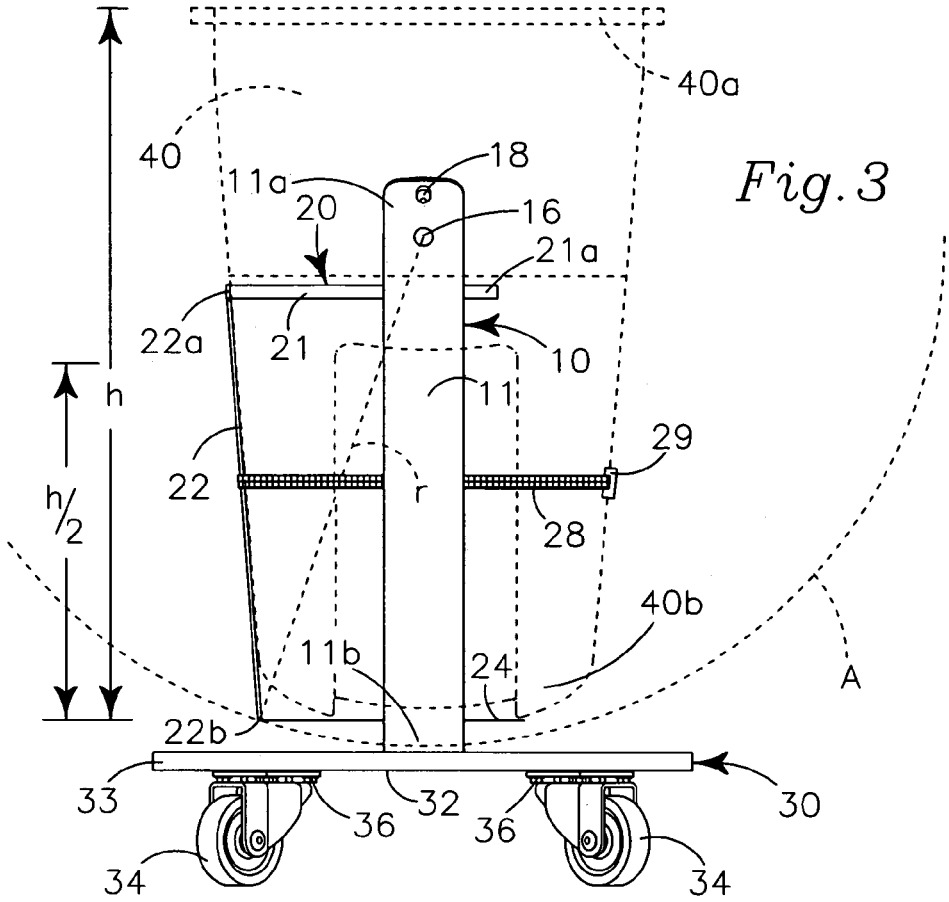
FIG. 3 is an orthographic side view of the trash container emptying mechanism showing a trash container, in dashed outline, within the carrier and the arc of pivot.
Figure 2:
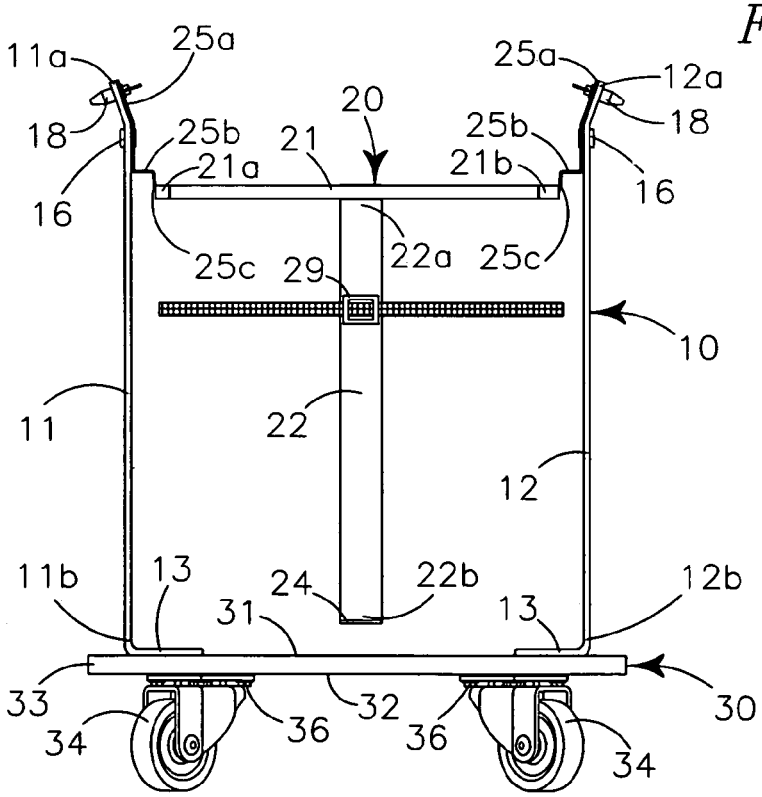
FIG. 2 is an orthographic front view thereof.
Figure 4:
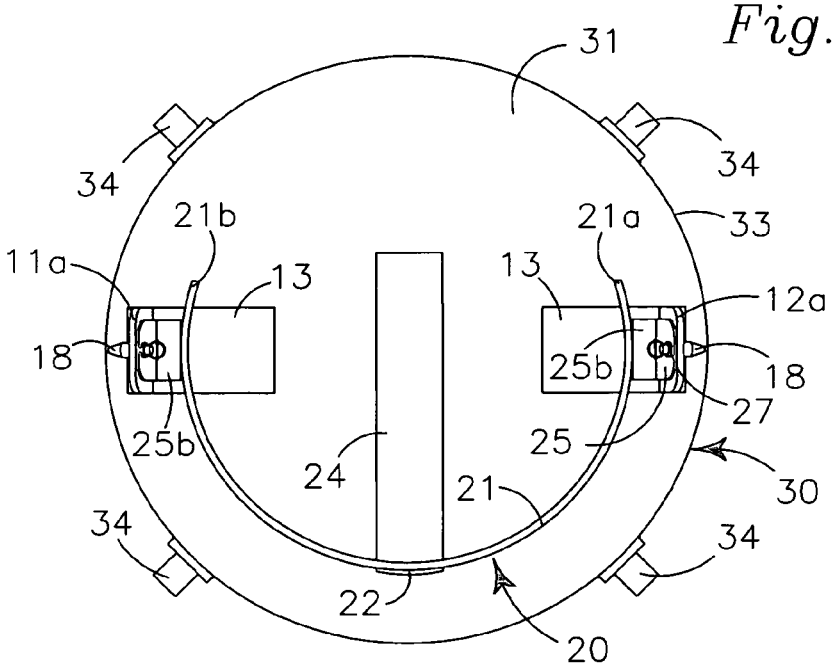
FIG. 4 is an orthographic top view of the trash container emptying mechanism.

As shown in FIG. 3, radius r which is the distance between the pivot axle 16 and arc of movement A, of the horizontal bottom support 24, is less than total height h of the trash container 40 and more than one half h/2 of the total height h of the trash container 40. The positioning of the pivot axles 16 vertically below the upper edge 40*a* of the trash container 40 and vertically above one half h/2 of the total height h of the trash container 40 causes the carrier 20 and trash container 40 thereon to swing as a pendulum on and between the two pivot axles 16. Because the pivot axle 16 position is also vertically below the upper edge 40*a* of the trash container 40, a portion of the mass (not shown) of a filled trash container 40 is carried vertically above the pivot axles 16. The mass (not shown) carried above the pivot axles 16 acts as a counterweight providing mechanical leverage that assists the pivoting the carrier 20 and the trash container 40 thereon about the pivot axles 16 when the trash container liner is removed from the trash container 40. The downwardly inwardly tapering of the trash container 40 allows more mass to be carried within the trash container 40 proximate the upper edge 40*a* than within the same amount of vertical space proximate the interior bottom portion of the trash container 40.

The wheeled cart 30 is a circular platform having a top 31, a bottom 32 and an edge portion 33 communicating between the top 31 and the bottom of 32 and extending circumferentially about the top 31 and bottom 32. Plural caster-type wheels 34 are spacedly arrayed about the bottom 32 and depend therefrom to provide mobility along a supporting surface while maintaining stability. The wheels 34 are mounted to the wheeled platform bottom 32 with fasteners 36. The caster wheels 34 may have known wheel brake assemblies (not shown) incorporated therein to prevent movement of the platform 30 when the brake assembly is activated. The wheeled cart 30 may also be a known janitorial cart (not shown) having facilities (not shown) for carrying items such as cleaning supplies.

In a second embodiment, as shown in FIG. 7, the rigid upper support 21 is annular in configuration and two diametrically spaced apart vertical legs 22, 23 communicate between the rigid upper support 21 and the horizontal bottom support 24. The first vertical leg 22 and the second vertical leg 23 each have an upper end portion 22*a*, 23*a* and an opposing lower end portion 22*b*, 23*b*. The upper end portions 22*a* 23*a* are structurally interconnected to the upper support 21 at diametrically opposed positions preferably 90 degrees separated, along the arc, from the offset pivot spacers 25. The lower end portions 22*b*, 23*b* are structurally attached to opposing end portions of the bottom support 24 which may be a rigid elongate member extending between the bottom portions 22*b*, 23*b*. The bottom support 24 may also be a bowl-like structure (not shown) defining a cavity to carry the bottom end portion of a trash container 40. Such a bowl-like bottom support 24 is desirable when there is a possibility of fluidic waste leaking from the trash container 40.

The vertical legs 22, 23 have some resiliency. The flexible strap 28, when tightened, compresses the vertical legs 22, 23 into direct physical contact with the outer circumferential surface of the trash container 40 providing frictional engagement therebetween.

Having described the structure of my trash container emptying mechanism its operation may be understood.

A locking pin 18 is inserted through the aligned locking pin holes 19, 27 defined in the upper end portions 11*a*, 12*a* of the yoke vertical arms 11, 12 and in the offset pivot spacers 25 to prevent the carrier 20 from pivoting relative to the yoke 10 and wheeled platform 30 while the trash container 40 is installed. The caster wheel brake assemblies (not shown) may also be activated to prevent the wheeled cart 30 from moving.

A known trash container 40 is secured in the carrier 20 by lifting the trash container 40 so that its bottom portion 40*b* rests upon the horizontal bottom support 24 and is supported thereon. The upper portion 40*a* of the trash container 40 is placed in direct physical contact with the rigid upper support 21 so that the rigid upper support 21 extends partially circumferentially about the circumference of the waste container 40 proximate the upper portion 40*a*. The adjustable strap 28 is passed about the trash container 40 and is secured in place by interconnecting opposing end portions of the strap 28 with the strap fastener 29. If the trash container 40 has radially extending handles (not shown) it may be necessary to axially "spin" the trash container 40 relative to the carrier 20 so that the handles do not contact the yoke vertical arms 11, 12 when the carrier 20 is pivoted. The flexible strap 28 is tightened so that the trash container 40 is forced into direct physical contact with the rigid upper support 21, the vertical leg 22 and the horizontal bottom support 24. A trash container liner (not shown) is placed in the trash container 40 and upper edge portions of the trash container liner are preferably stretched to extend over and about the upper circumferential edge portions 40*a* of the trash container 40 so that the liner is positionally maintained within the trash container 40 and materials deposited in the trash container 40 are collected within the liner.

The user may go about his duties adding material to the trash container 40. When the trash container 40 is full, or the user is ready to empty the trash container 40, such as after the waste collection is complete, the user activates the caster wheel brake assemblies (not shown) and removes the locking pins 18 from the aligned locking pin holes 19, 27 defined in the upper end portions 11*a*, 12*a* of the yoke vertical arms 11, 12 and in the offset pivot spacers 25. The user pivots the carrier 20 and the trash container 40 thereon either by lifting the lower portion 40*b* of the trash container 40, or by pushing downwardly on the upper circumferential edge 40*a* portion of the trash container 40 at a position medially between the two yoke vertical arms 11, 12 so that the bottom end portion 40*b* of the trash container 40 and carrier 20 pivot in arc A about the pivot axles 16. As the trash container 40 and carrier 20 pivot, the upper end portion 40*a* of the trash container 40 moves downwardly along an arc (not shown) as the bottom end portion 40*b* of the trash container 40 moves upwardly along arc A until the bottom end portion 40*b* of the trash container 40 is at a position vertically higher than the upper portion 40*a*.

While the trash container 40 is angulated, the user pulls the "filled" trash container liner and waste contained therein, out of the trash container 40 without having to lift the liner and waste upwardly to a height sufficient to "clear" the upper edge 40*a* of the trash container 40. The filled liner falls from the trash container 40 onto the supporting ground surface and can be disposed of as desired. If the filled liner is removed from the trash container 40 on a loading dock proximate to a waste dumpster, the full trash container liner may be dragged to, and pushed into, the dumpster for disposal. The user is not required to lift the filled liner and material therein to remove it from the trash container 40.

The foregoing description of my invention is necessarily of a detailed nature so that a specific embodiment of a best mode may be set forth as is required, but it is to be understood that various modifications of details, and rearrangement, substitution and multiplication of parts may be resorted to without departing from its spirit, essence or scope.

Having thusly described my invention, what I desire to protect by Letters Patent, and what I claim is:

1. A trash container emptying mechanism for supporting a tapered vertical trash container having an upper orifice and a bottom at least a portion of the trash container emptying mechanism pivotal to an angled position with the upper orifice lower than the bottom so that material in the trash container is biased by gravity toward moving therefrom, comprising in combination:

a yoke having, two vertically oriented horizontally spaced arms each having an upper end portion defining an axle hole, and an opposing lower end portion carrying a horizontal base to extend perpendicularly to each vertical arm and interconnecting the lower end portions of each vertical arm;

a carrier pivotally interconnected to the yoke for pivoting the tapered trash container in opposing directions, the carrier having, a rigid upper support in the shape of an annulus that extends completely circumferentially about the trash container spacedly below the upper orifice, the upper support carrying offset pivot spacers at diametrically opposed positions, each offset pivot spacer having an upper end portion defining an axle hole, a medial offset bend to accommodate the taper of the trash container and a lower end portion communicating with the rigid upper support, a bottom support spaced vertically below the upper support, the bottom support having at least one vertical leg with an upper end portion communicating with the rigid upper support and a lower end portion structurally carrying the bottom support which is a circular bowl shaped member defining a cavity for supporting the trash container, axles extending through each axle hole defined in the upper end portion of each vertical arm and through axle hole defined in the upper end portion of each offset pivot spacer, a flexible strap having an adjustable fastening means joining opposing end portions of the flexible strap together communicating with the carrier to releasably secure a trash container within the carrier;

a locking means for releasably securing the carrier in an upright orientation relative to the yoke, the locking means having a locking pin extending through a locking pin hole defined in the upper end portion of at least one vertical arm and through an aligned locking pin hole defined in the offset pivot spacer; and a wheeled cart having an upper surface securely supporting the yoke and an opposing bottom surface carrying plural spacedly arrayed depending wheels for movement over a supporting surface; and the vertical height of the pivot axles above the carrier bottom support is more than 60% of the vertical height of the trash container and less than 90% of the vertical height of the trash container.

2. The trash container emptying mechanism of claim 1 wherein the vertical height of the pivot axles above the carrier bottom support is 70% of the vertical height of the trash container.

* * * * *